US007327256B2

(12) United States Patent
Gary, Jr.

(10) Patent No.: US 7,327,256 B2
(45) **Date of Patent: *Feb. 5, 2008**

(54) SYSTEMS AND METHODS FOR TAGGING AND IDENTIFICATION

(75) Inventor: Wyndham F. Gary, Jr., Whitefish Bay, WI (US)

(73) Assignee: RF Technologies, Inc., Brookfield, WI (US)

( * ) Notice: Subject to any disclaimer, the term of this patent is extended or adjusted under 35 U.S.C. 154(b) by 205 days.

This patent is subject to a terminal disclaimer.

(21) Appl. No.: 10/872,043

(22) Filed: Jun. 18, 2004

(65) Prior Publication Data

US 2005/0280535 A1 Dec. 22, 2005

(51) Int. Cl.
*G08B 13/14* (2006.01)
*G08B 1/08* (2006.01)
*G08B 23/00* (2006.01)

(52) U.S. Cl. ..... 340/572.1; 340/539.15; 340/573.1

(58) Field of Classification Search ..... 340/572.1, 340/573.1, 539.1–539.26, 573.3, 573.4
See application file for complete search history.

(56) References Cited

U.S. PATENT DOCUMENTS 5,369,800 A * 11/1994 Takagi et al. ..... 455/59
5,608,382 A * 3/1997 Webb et al. ..... 340/573.4
5,661,460 A * 8/1997 Sallen et al. ..... 340/573.4
5,793,290 A * 8/1998 Eagleson et al. ..... 340/573.4
6,211,790 B1 * 4/2001 Radomsky et al. ..... 340/573.4
6,745,008 B1 * 6/2004 Carrender et al. ..... 455/41.1
6,753,781 B2 * 6/2004 Radomsky et al. ..... 340/573.4
6,977,586 B2 * 12/2005 Martin et al. ..... 340/539.15
7,005,985 B1 * 2/2006 Steeves ..... 340/572.1
2005/0073419 A1 * 4/2005 Gary, Jr. ..... 340/573.1

* cited by examiner

*Primary Examiner*—Toan N. Pham
(74) *Attorney, Agent, or Firm*—Foley & Lardner LLP

(57) ABSTRACT

A mother and infant matching and security system is disclosed. The mother and infant matching and security system comprises a first tag unit adapted to be secured to an infant. The first tag unit is operable to transmit a first signal having a low frequency and a second signal having a very high frequency. The mother and infant matching and security system also comprises a second tag unit adapted to be secured to a mother of the infant. The second tag unit has a radio communication link with the first tag unit. The mother and infant matching and security system further comprises a communications protocol used by the first tag unit to communicate via the radio communications link with the second tag unit. A match of the first tag unit and second tag unit is identified by both an audio indicator and a visual indicator on at least one of the first tag unit and the second tag unit.

42 Claims, 8 Drawing Sheets

FIG. 6
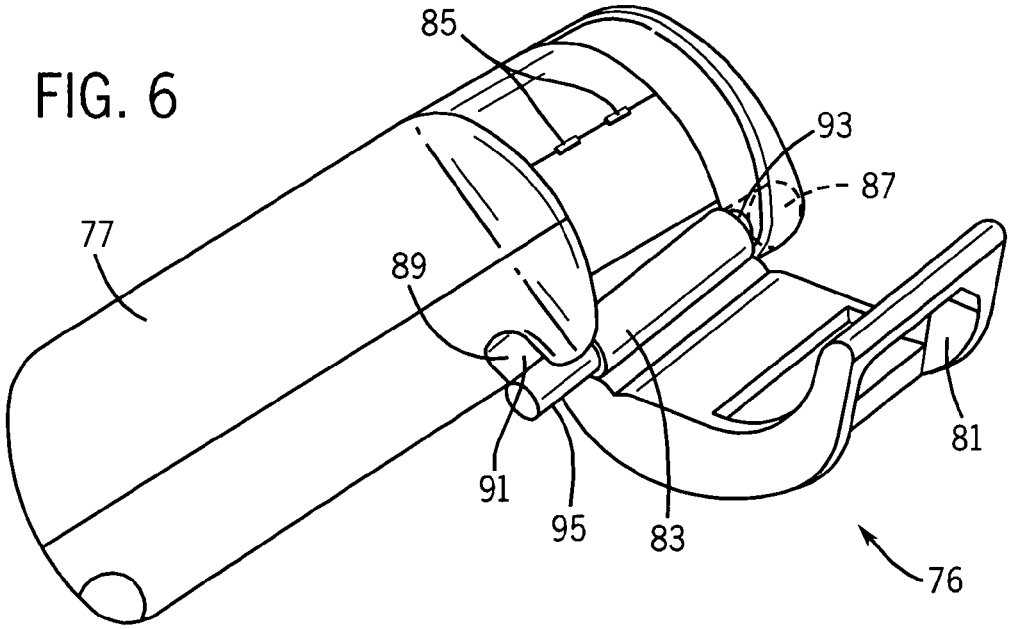
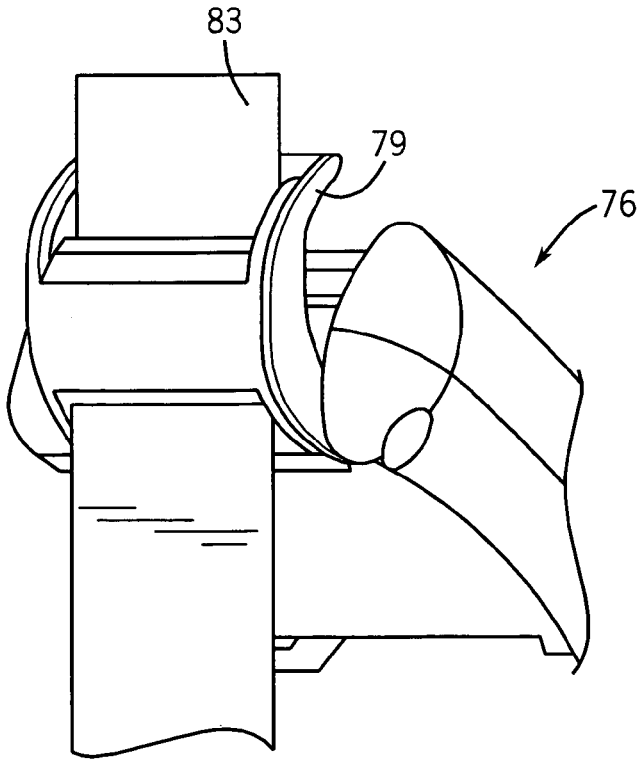
FIG. 7

SYSTEMS AND METHODS FOR TAGGING AND IDENTIFICATION

BACKGROUND

The present invention relates to systems and methods for matching and maintaining correlation between a parent and an infant within an environment such as a hospital.

The present invention aids in assuring that an infant or infants born to a mother remain matched with their mother when the mother and infant(s) leave the hospital or when the infant or infant and mother are separated and then are properly re-matched in the hospital.

The possible abduction of an infant or child from medical facilities, such as hospitals, other medical structures, temporary housing and other restricted areas has created a significant demand for monitoring systems which signal any unwarranted movement of the infant or child from the assigned environment or area. The standard method used heretofore, such as visitor passes, monitoring cameras, and standard door monitors have not provided the necessary protection against such unwarranted movement of personnel, and particularly an infant or child, from an assigned or restricted area. Hospitals and like facilities are thus continuously looking for improved systems which will essentially prevent unwarranted movement and abduction of an infant or child, thereby maintaining a very safe and secure environment for the infants and other such personnel. The present invention has been particularly developed in relation to an infant and a parent and is therefore described with reference thereto. The systems and methods may, of course, be applied to other persons or objects and even other applications (e.g., nursing homes, etc.).

Systems have been proposed in which an alarming band unit is connected to the monitored child. The restricted area includes strategically located receivers throughout the restricted area. The receivers are responsive to the output of the alarming band unit and coupled to one or more controllers. The alarming band unit includes a transmitter unit for establishing a control signal when the band unit is moved adjacent to an alarm receiver. The band alarming unit is constructed such that any tampering or removal of the alarming band unit also generates a wider area alarm signal. The local area receivers are small units, which are suitably mounted adjacent to the strategic location, such as a door, hall, elevator, stairway, or the like, and are generally interconnected to an alarm control unit. The receivers are generally mounted to a wall, ceiling, or other similar locations and are hard wired to a controller unit. The latter, in turn, is generally mounted in the restricted area and coupled to alarm or alert units mounted for signaling the staff, such as the nursing staff and security personnel as well as providing certain interlocks to restrict movement of the monitored child. Generally, if the alarming band unit is compromised in any way, the transmitter sends the signal to additional, wide area receivers and/or detects the loss of the signal and will immediately generate an appropriate response, which may be an alarm transmission to other remote locations, and the like.

Various systems have been suggested. For example, U.S. Pat. No. 5,014,040, to Weaver, discloses a personal locator adapted to be mounted to the wrist or leg of the infant or any other monitored person. The locator consists of a small transmitter having an attachment band integrally secured to the transmitter housing, which preferably has the appearance of a wristwatch or the like. The integrally connected band is adapted to be wrapped about the arm and then secured within an opening within the opposite side of the transmitter housing. The band itself has embedded therein conductors which are interconnected to the transmitter at the integral connection and also through a releasable connector at the opposite strap connector which receives the free end of the attachment strap. The transmitter generates a unique identification code information or the like, which is transmitted with sufficient power to cover the restricted area in which receivers are mounted directly or as a result of selected movement within an area.

Some prior art systems use alternate systems of monitoring. For example, U.S. Pat. No. 6,211,790, to Radomsky, uses both infrared (IR) and radio frequency (RF) for monitoring purposes. As shown in U.S. Pat. No. 6,211,790, a dual-mode infrared/radio frequency (IR/RF) transmitter is secured within a wristband worn by the mother and within an ankle and/or wristband worn by the infant. In a matching mode of operation, IR signals are received by infrared receivers located within various rooms of a hospital to precisely and automatically determine by proximity that mother and infant are correctly united. In a presence detecting mode, RF signals from the infant's badge are detected by RF receivers located throughout the maternity ward of the hospital or throughout the hospital generally. In a security mode, RF receivers located proximate exits of either of the maternity ward and/or the hospital detect RF signals from the ankle and provide a signal to generate an alarm.

Some systems use a transponder system wherein a non-transmitting individual personalized unit is secured to the person. The unit transmits a coded signal upon being interrogated by a remote detector or a remote monitoring unit. Alternatively, a portable self-contained transmitting and receiving device is worn by the personnel, and when it enters into a selected area, it activates a control unit to effect an alarm condition. Under an alarm condition, an audible or visual signal may be generated at one or more locations. In addition, various securing action may be taken, such as locking of a door, deactivating of an elevator system, providing notifications at local and remote stations, as well as any other option, which may be desired to be incorporated into a system to secure the locations as well as protect the personnel.

Authorized personnel will normally have deactivation systems which permit them to undertake normal personnel servicing and the like. In addition, it is highly desirable to prevent tampering with the system, particularly the child attached unit and the receiver units. Thus, any unauthorized attempt to remove the unit from the person being monitored, or tampering therewith in such a manner as to defeat the security system, must automatically create an alarm or an alert condition for appropriate monitoring and action.

Although various systems presently exist in personal monitoring systems, many of which are particularly directed to the monitoring of movement of infants and children in hospitals and other like areas or facilities, there is a continuing need for reliable security systems which are highly cost effective. Both the monitor unit attached to the person as well as the monitoring sensors must be secure and effective under essentially all positioning and movements of the monitored person. Furthermore, the monitoring systems need to be adaptable to the specific person so that the systems can be better utilized to protect the individual.

U.S. Patent No. 5,793,290 to Eagleson, incorporated herein by reference in its entirety, was such a design that efficiently monitors children and infants in hospitals and other like areas or facilities. In Eagleson, a security system for monitoring movement of persons in a secured area including set openings which includes area and opening monitors, tag units and an alarm system is disclosed. The tag unit has special end clamp members that securely clamp an attachment strap to a housing for attaching the unit to a person. Tampering with the connection creates an alarm state. The tag unit includes a dual transmitter continuously transmitting very low frequency (VLF) signal and transmitting a very high frequency (VHF or UHF) signal only if the tag unit is tampered with. The opening monitor includes VLF receivers responsive to a VLF signal and transmitting an alarm signal to an opening alarm system to prevent unauthorized exit. Authorized personnel have a deactivation unit for timed receiver disabling for moving the person through the opening. The UHF transmitter is activated upon unauthorized tampering with the attached tag. A bank response alarm includes a plurality of distributed VHF or UHF receivers that responds to the VHF or UHF signal of any tag unit. A deactivation control is provided to authorized personnel to permit attachment and removal of the tag unit. Other interlocks may be provided including visual and/or audible alarms, tag identification and, data recording.

Accordingly, there is a need for a mother/infant tag system which when the mother and infant are matched provides both visual and audible indications of a match. Further, there is a need for a mother/infant matching system in which the visual indication of a mother/infant match is provided on a constant basis while the mother and infant remain matched. Further, there is a need for a mother and infant matching system in which the tag, after being removed from the patient, erases itself and returns to a hibernated state for later reuse. There is a need for a mother and infant matching system in which mother and infant tags automatically reactivate when the tags are moved a predetermined distance from each for more than a predetermined amount of time. Further still, there is a need for a mother/infant matching system in which a mother may be matched with multiple infants in the case of multiple births. Yet further still, there is a need for a mother and infant matching system in which the mother may be able to manually perform a match.

It would be desirable to provide a system and/or method that provides one or more of these or other advantageous features. Other features and advantages will be made apparent from the present specification. The teachings disclosed extend to those embodiments which fall within the scope of the appended claims, regardless of whether they accomplish one or more of the aforementioned needs.

SUMMARY

An example of the invention relates to a mother and infant matching and security system. The mother and infant matching and security system comprises a first tag unit adapted to be secured to an infant, the first tag unit is operable to transmit a first signal having a low frequency and a second signal having a very high frequency. The mother and infant matching and security system also comprises a second tag unit adapted to be secured to a mother of the infant, the second tag unit has a radio communication link with the first tag unit. The mother and infant matching and security system further comprises a communications protocol used by the first tag unit to communicate via the radio communications link with the second tag unit. A match of the first tag unit and second tag unit is identified by both an audio indicator and a visual indicator on at least one of the first tag unit and the second tag unit.

Another example of the invention relates to method of identifying two matching persons or objects. The method comprises securing a first tag unit to a first person or object. The first tag unit is operable to transmit a first signal having a low frequency and a second signal having a very high frequency. The method also comprises securing a second tag unit to a second person or object. The second tag unit has a radio communication link with the first tag unit. The method further comprises communicating using a predefined communications protocol from the first tag unit to the second tag unit via a radio communications link and identifying a match of the first tag unit and the second tag unit by both an audio indicator and a visual indicator on at least one of the first tag unit and the second tag unit.

Yet another example of the invention relates to a tagging and identification system. The tagging and identification system comprises a first communications network, a server coupled to the first communications network, a tag unit receiver coupled to the first communications network, and a first tag unit adapted to be secured to an infant. The first tag unit is operable to transmit a first signal having a low frequency and a second signal having a very high frequency. The tagging and identification system also comprises a second tag unit adapted to be secured to a mother of the infant. The second tag unit has a radio communication link with the first tag unit and a communications protocol used by the first tag unit to communicate via the radio communications link with the second tag unit. A match of the first tag unit and second tag unit is identified by both an audio indicator and a visual indicator on at least one of the first tag unit and the second tag unit.

Alternative examples and other exemplary embodiments relate to other features and combination of features as may be generally recited in the claims.

BRIEF DESCRIPTION OF THE DRAWINGS

The subject matter described herein will become more fully understood from the following detailed description, taken in conjunction with the accompanying drawings, wherein like reference numerals refer to like elements, in which:

FIGS. 4-9 are various views of a mother tag according to various embodiments.

DETAILED DESCRIPTION OF PREFERRED AND EXEMPLARY EMBODIMENTS

Figure 1:
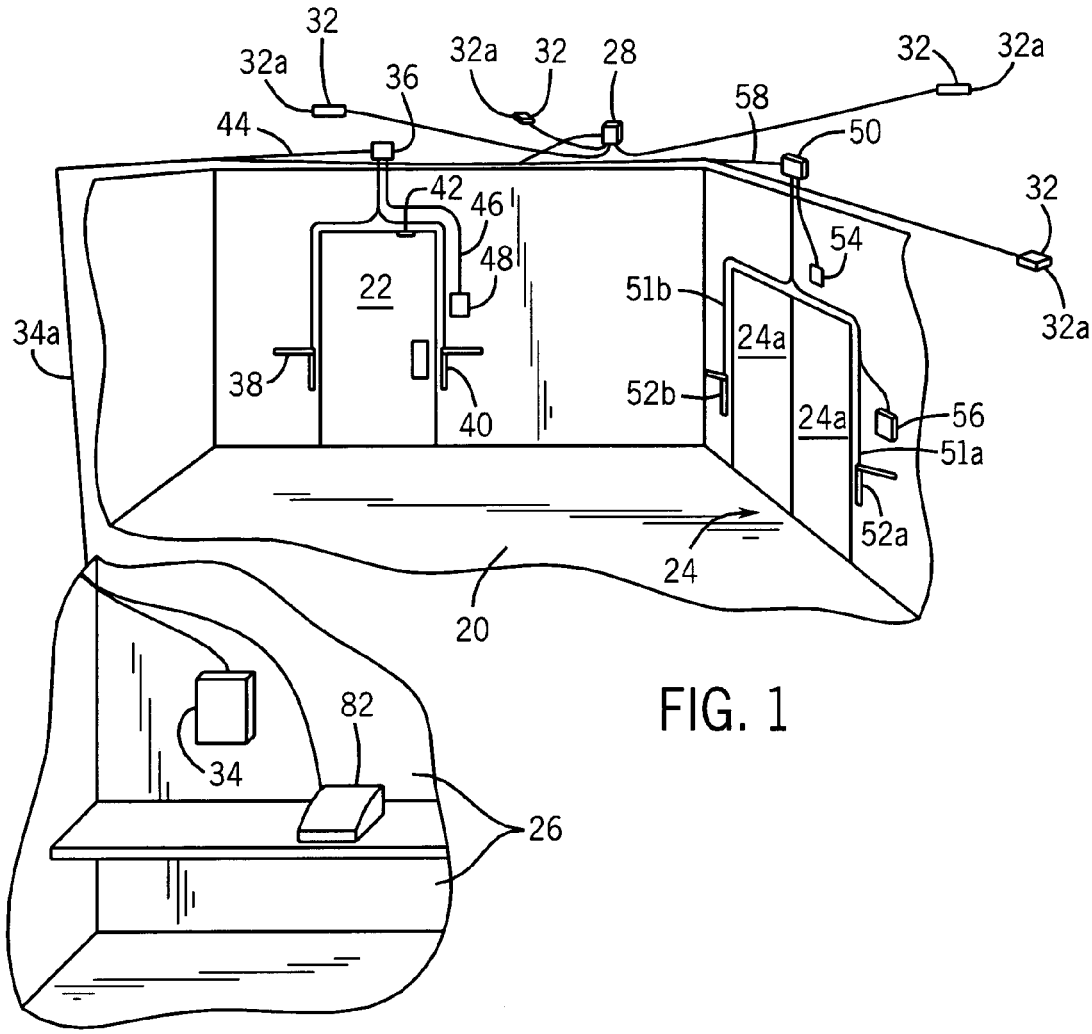
FIG. 1 is a diagrammatic illustration of a secure area incorporating a security system constructed according to one embodiment.

Before describing in detail the particular improved system and method, it should be observed that the invention includes, but is not limited to a novel structural combination of conventional data/signal processing components and communications circuits, and not in the particular detailed configurations thereof. Accordingly, the structure, methods, functions, control and arrangement of conventional components and circuits have, for the most part, been illustrated in the drawings by readily understandable block representations and schematic diagrams, in order not to obscure the disclosure with structural details which will be readily apparent to those skilled in the art, having the benefit of the description herein. Further, the invention is not limited to the particular embodiments depicted in the exemplary diagrams, but should be construed in accordance with the language in the claims.

An exemplary embodiment is directed to a system having a dual transmitting monitor or tag unit coupled to the monitored child or infant and having distinct dual signal modes in combination with strategically located receiving units and controllers to separately respond to the dual signals. Thus, generally a small tag unit includes a dual signal transmitting system establishing two distinctly different signals, the tag unit includes an attachment band or strap for interconnection to the child, other personnel or object to be monitored with the tag unit. The strap is specially coupled to the transmitting unit such that any removal of or separation within the strap results in the transmission of an alarm signal. The alarming strap signal is transmitted over a wide area to allow the alarming strap signal to be received regardless of where the monitored child is located. The transmitting unit also transmits a much more restricted area signal which only activates receivers at selected locations and thereby monitors the movement of the banded child at certain locations in the restricted area, and particularly into an entry/exit location. Thus, if the alarming strap is cut, the system wiring tampered with, or just removed without deactivation of the system, an alarm signal is automatically and promptly created. If the child, however, properly wearing the dual tag unit moves into a restricted area, the strategically located receiver unit will instantly respond, subject to any desired delay or override features built into the system, and create an alarm or alert condition.

More particularly, in accordance with the teaching of an exemplary embodiment of the present invention, the tag unit includes a battery operated RF transmitter. In a preferred construction, the tag unit includes a lightweight, waterproof transmitting housing connected by a hypoallergenic band or strap for attachment to the child. The strap is interconnected at the opposite ends to the sides of the housing with at least one releasable connector, and preferably opposite strap connectors, to secure the band to the housing and thereby attach the tag unit in a comfortable manner to the child with any excess band trimmed and removed. The transmitter is sealed within the housing, with the circuit connection completed through wiring within the strap. Any opening of the connection to either side or otherwise interfering with the strap, such as cutting of the strap, will trigger an alarm condition. This ensures continuous operation of the transmitter units and response by the system monitors. The receiver units are secured to the entrance/exit locations such as a doorway, hallway, elevator, stairway, or the like.

In accordance with an exemplary embodiment, the alarming tag unit includes a first transmitter operating at a high frequency, and preferably ultra high frequency (UHF). The UHF transmitter is normally in an off condition although a signal may be transmitted on a periodic basis for supervision purposes. Any tampering with the band or strap of the tag unit, however, immediately creates the UHF signal which is transmitted throughout the restricted area and is received by any one of the UHF receivers and establishes the alarm alert condition. A second transmitter, however, continuously operates and generates a low frequency signal and preferably a very low frequency (VLF), which is confined to a well-defined zone about the child. Use of VLF is desirable as it prevents the shielding of the signal with the body of some person who inadvertently or intentionally attempts to separate and interfere with the transmission of the monitor signal to the receiving units at any entrance/exit location.

Generally, the VLF signal will be below the AM broadcast band. In contrast, the high frequency signal will be an ultra high frequency (UHF) signal substantially above the AM broadcast band.

In addition, selected authorized personnel are provided with a deactivation unit that will deactivate the particular strategically located receiver units to permit removal of the monitor from the child and/or permit the child to be moved from the secured area. For example, in a hospital, nursing staff may be required to remove an infant or child for additional medical attention or procedure. The bypass feature also allows re-entry into the restricted area. The deactivation system also allows the removal of the alarming band unit. The strap itself is readily removed and disposed of, while the transmitter is preferably a sealed unit, which can be readily cleaned for reuse.

In an exemplary construction, the basic alarm system for infant and child security and the like, will include three basic elements consisting of 1) a perimeter exit system; 2) a cut/removed band or strap detection system; and 3) a display/alarm/monitoring system. In systems particularly applied to infant and child monitoring, a small transmitting unit appropriate to their size is provided. In order to accommodate this relatively small size, at least two receivers for a single door, and four receivers for double doors, generally mounted orthogonally to each other, and the like are applied as a minimum to the perimeter of the door system and thereby improves the signal pickup as well as eliminating an orientation problem. The monitoring system may include interlocking control systems. For example, a door exit may have an interlock that will limit an alarm response to the actual attempt to open the door. This may be necessary in a secure system where the infant or child would necessarily move near an alarm door for certain reasons, for example, a door located along a busy hallway within the secured area.

Magnetic door locks are often used in areas to selectively lock a door under an alert condition, with the alarm set upon actual opening of the door. Because of fire safety codes and the like, the "maglock" unit must release after a very short period if continuous pressure is applied to the door. Actual opening will then affect the local alarm conditions.

The band alarm control system preferably uses a multiple and overlapping receiver cells system, similar to the concept of cellular radio systems. This ensures reception of the high frequency alarm signal. Thus, a controller for the system is located with the receivers in the ceiling, sides, and the like, and the alarm will lock local and remote sites, and are then generally reset only from the remote site to a local area. If desired, local reset can be provided.

In addition to the basic lock and control system, various options can be provided such as display at various combinations of local and remote alarm stations.

Further, the local alarms can be coded to distinguish between controllers and each controller can be separately or uniquely coupled to drive a remote panel, which displays the controller location to one or more alert panels. Individual identification labels can be applied and displayed at a desired alert panel structure, such as a common "Visinet" console, which may or may not have a printing system attached for purposes of maintaining a printed record of the outputs. Systems with such a cable terminal output can, of course, also provide input into a main console computer for various functions related to the security and record purposes. The display can also provide for display of the system through use of appropriate software which will not only lay out the system but separately identify the location of an alarm site, and if necessary or desired, appropriate recording thereof, in detail, as well as providing visual indication of the location by infant number, name and the like. The system can include voice alarm as well as wireless paging systems.

Various combinations of the system can be applied to the particular requirements of the facilities to maintain maximum degrees of specifications of security as desired and required.

The system also incorporates a matching system for a mother and an infant. When the mother is brought into the hospital, the mother is given a tag to wear. The tag is then linked to a tag the infant wears. During the hospital stay, a signal will be given whether the mother and child match when the mother's tag is brought near the infant's tag. The tags will be linked until the mother and infant are discharged from the hospital, at which time they are erased.

In general, the system uses a computer program to keep a record of each time a child is matched to a mother, and display any alarm or warning events, from the initialization of the system to the discharge of the mother and infant. The system can be programmed for a mother to be linked to multiple infants. In one embodiment, the initialization/erasure component of the system contains a key lock, to ensure that the information for a mother-infant is not tampered with.

The system can also be utilized to store personal information for the mother and infant. For instance, the patient's blood type could be stored in the transmitter. The transmitter would be brought near a unit of blood. If the patient's blood type matched the type of the unit of blood, a positive indication would show, whereas if the blood types did not match, there would be a negative warning.

In summary, the present invention provides an alarm monitoring system for providing safe and secure environments, particularly for newborns and children, parents and medical staff within a secured facility based on a cost effective combination of a dual transmitting tag unit attached to the person and a plurality of receivers appropriately located within the secured areas and responsive to tampering of the tag unit and unauthorized movement of the monitored persons.

FIG. 1 is a diagrammatic illustration of a hospital (e.g., maternity ward, etc.) or other area 20 in which infants and children may be temporarily housed after birth or while receiving medical care and the like, and which is generally provided with security features to protect the infant or child from being abducted or wandering off. A protected area 20 has a door 22 for entering and exiting the area. Other entrance/exit points might include an elevator 24 with doors 24A. The various rooms and other areas associated with infant care and housing generally include a suitable communication system to a control station, e.g., a nurse's station, a main security station or the like, shown at 26.

Still referring to FIG. 1, a high frequency controller 28 is mounted, preferably in hidden relation within the secured areas, and includes circuitry responsive to a UHF signal generated by an identification tag or infant tag 30 (see FIG. 2) attached to a child or children within secured area 20. The single UHF controller 28 may control a relatively substantial secured area 20. A plurality of high frequency antenna receivers 32, each with a suitable antenna 32A, may be coupled to controller 28 and distributed throughout secured area 20.

If a tag 30 within secured area 20 is removed from the area or tampered with to avoid security, the UHF signal is generated and detected by one or more of the receivers 32 and transmitted to a controller 28, thereby creating an alarm state.

Controller 28 may have a local alarm unit, which will create a visual and/or audible alarm within the immediate secured area. In addition, it is desirably connected to the central or control station 26, which has an appropriate monitoring unit 34, including an alarm unit. Typically, control station 26 includes a computer of a conventional type and size. However, other systems may be included as part of control station 26 in place of or to complement the computer. Generally, the various elements are cabled or hard wired, with hidden wiring, for example as shown by cable 34*a*. The wiring may be provided with appropriate security to prevent tampering therewith.

With continued reference to FIG. 1, a door controller 36 is mounted above door 22, and preferably hidden from view within the wall structure. Low frequency receivers 38 and 40 are located adjacent to door 22 to pick up very low frequency (VLF) signals generated by a tag 30 as a monitored child approaches the door 22. Receivers 38 and 40 can be located to maintain response in the event of one attempting to defeat the security by orientating and shielding the movement of a tag 30 in the field of receivers 38 and 40.

Door controller 36 is responsive only to an actual attempt to open door 22 in an unauthorized manner. A suitable switch unit 42 is coupled to door 22 to respond and sense the actual opening or attempt to open door 22. Switch unit 42 may typically be a reed switch having a door mounted member and a fixed wall mounted member as shown, an infrared responsive switch assembly similarly mounted, or any other suitable and desired sensing system, which will generate an appropriate signal to controller 36 upon the initiation and/or actual opening of door 22. Such a condition in the presence of a VLF signal from tag 30 generates an alarm state with the corresponding local alarm condition and preferably a remote alarm signaling. Thus, under an alarm state, the output of controller 36 would transmit a signal via a cable 44 to remote unit 34. In addition, controller 36 may be connected by a cable 46 to a control unit 48 having an alarm unit built therein.

For other exits, such as elevator 24, a separate controller 50 is provided. As FIG. 1 illustrates, controller 50 is coupled by input cables 51*a* and 51*b* to a pair of orthogonal low frequency receivers 52*b* and 52*b*, respectively, which are suitably mounted to opposite sides of elevator doors 24A. The security system for an elevator unit is also typical of any double door unit to a room or area. Thus, at a double door unit, each set of receivers 52*a* and 52*b* includes a vertical and a horizontal oriented receiver, as shown. A door interlock 54 may be provided and interconnected to controller 50 to respond to the attempt to use elevator 24. In this instance, the response may allow doors 24A to open but prevent closing and therefore operation of the elevator. An elevator door control unit 56 is shown adjacent the elevator and wired to controller 50 and through cable 58 to remote alert unit 34. The control unit 56 includes a suitable alarm and interrelated control.

Figure 2:
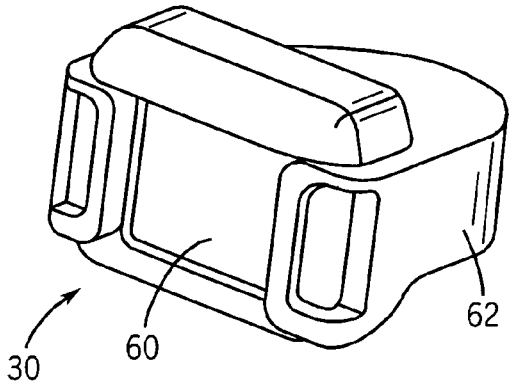
FIG. 2 is a perspective view of a tag unit constructed for releasable attachment with a child's limb.

Referring to FIG. 2, one embodiment of an identification tag 30 which is configured to be attached to the child is shown. Tag 30 includes a transmitter 60, which is operative to generate two distinct radio-frequency (RF) signals, as more fully developed hereinafter. Identification tag 30 is secured to the infant by a strap 62, which is interconnected to the opposite sides of transmitter 60, and is specially constructed to complete the circuitry of the transmitting circuitry within transmitter 60. Although the strap mounted transmitter unit 60 may include any desired structure, the structure preferably includes a mechanical interlock between transmitter 60 and strap 62, with circuit connections to control the transmitting circuitry and sound an alarm with tampering or unauthorized removal of strap 62. Also, as more fully developed hereinafter, tag 30 is conventionally attached to the wrist, or to the leg immediately above the ankle, of the infant and activated to generate the two distinctly different RF signals. In an exemplary construction, transmitter 60 generates a low frequency RF signal, or a VLF signal, for monitoring the exit and entrance of an infant within monitored secured areas 20, and an ultra high frequency signal, or a UHF signal, to monitor any removal or other tampering of the attachment of the tag 30 on an infant. Secured areas 20 are provided with appropriate receiving devices for responding to the respective signals, as follows.

Each tag 30 may create a unique encoded VLF signal and the controllers 36, 50 may decode that unique identification and transmit such identification to a local or remote station, such as station 26 (FIG. 1).

Figure 3:
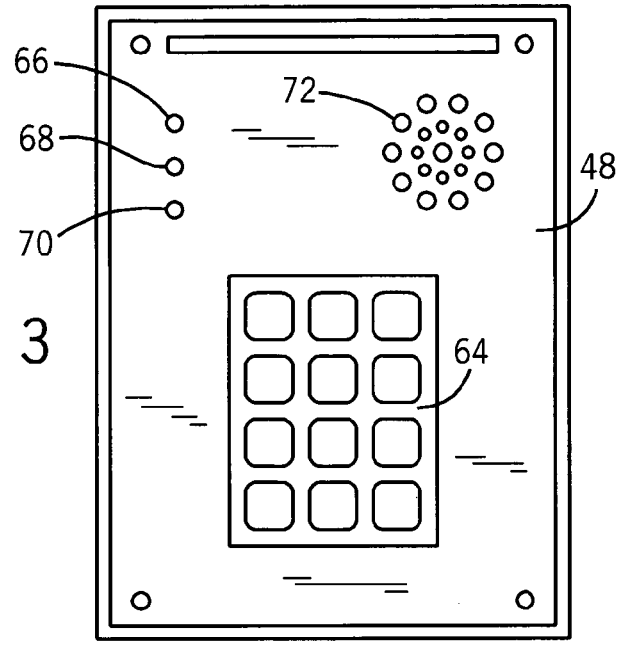
FIG. 3 is an elevational view of a control unit shown in FIG. 1 for monitoring an entrance/exit to the secured area.

FIG. 3 shows a typical local door control unit 48, or 56. Thus, door control unit 48 desirably includes a keypad panel 64 which may be used for entering of a particular code into door unit 48 (and thereby controller 36) by authorized personnel. This arrangement prevents creation of an alarm upon actual opening of the door with the corresponding coded tag unit in the area of the receivers. In addition, door control unit 48 includes status lights, shown as an "on" status light 66, an "active" status light 68, and a "bypass" light 70, the latter indicating that a deactivation code has been entered and accepted. When deactivation light 70 is turned on door 22 may be opened without producing an alarm for a selected short time period, e.g., preset between 5 and 60 seconds. The control unit 48 is diagrammatically illustrated with an audible alarm 72, which is activated in the event of an unauthorized location of tag 30 (FIG. 2) adjacent door 22. As will be apparent to one skilled in the art, unit 56 may be similarly constructed.

Figure 4:
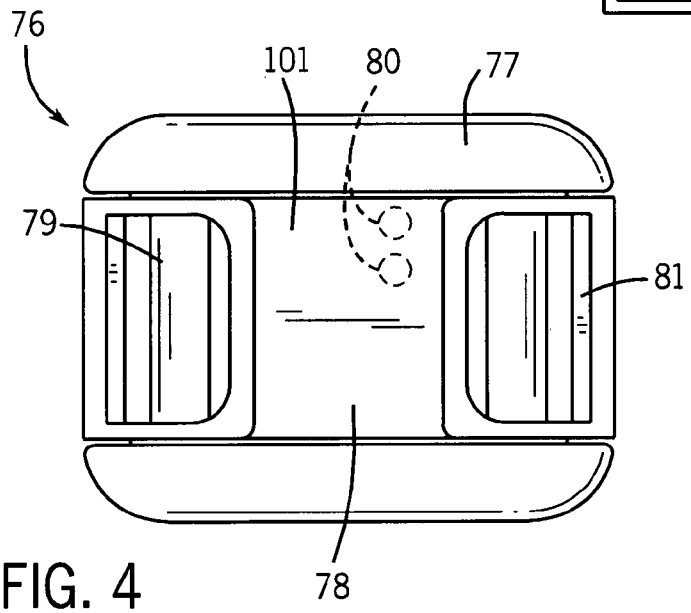
Figure 5:
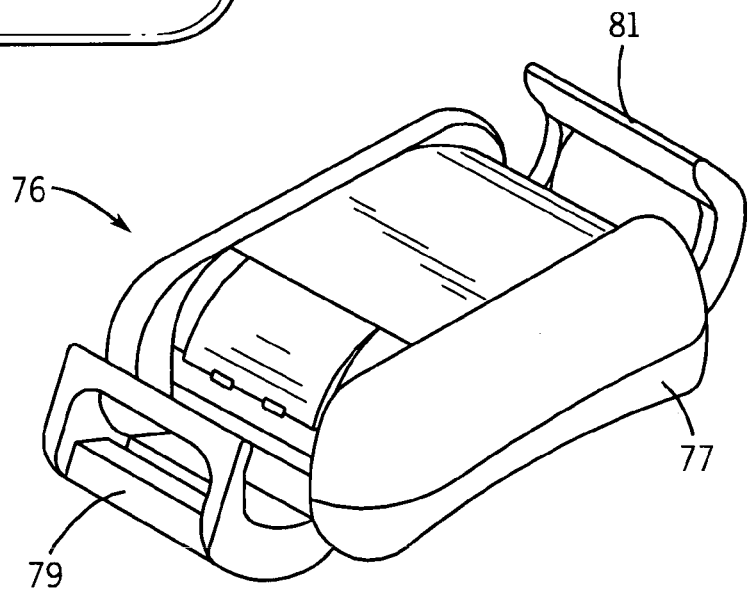

FIG. 4 shows an overhead view of a tag 76 that may be worn by the mother. Mother tag comprises a band 75 (FIG. 7), a transmitter 77, a first connector 79, and a second connector 81. Mother tag 76 is coupled to a mother using the band 75. In one embodiment the band 75 is in electrical communication with transmitter 77. If electrical communication through the band 75 is disrupted (e.g., the band is removed, cut, etc.) then the system moves to an alarm condition. The band 75 is coupled to the transmitter 77 using first and second connectors 79, 81. In this embodiment, first and second connectors 79, 81 are clamps that pivot about an axis defined by a pin 83 between an open position shown in FIG. 5 and a closed position shown in FIG. 4. Other embodiments may utilize any suitable coupling device or method to position band 75 in electrical communication with transmitter 77.

In one embodiment, first and second connectors 79, 81 are removable from mother tag 76. Referring to FIG. 6, mother tag comprises a first hole 87 and a second hole 89 which cooperate with a first end 93 and a second end 95, respectively, of pin 83 to permit second connector 81 to move relative to transmitter 77. First hole 87 is enclosed so that first end 93 is received in hole 87 by moving first end 93 in the general direction of a longitudinal axis defined by hole 87. Second hole 89 is not completely enclosed so that once first end 93 has been received by first hole 87, second end 95 is moved into second hole 89 through an opening 91. As shown in FIG. 6, second end 93 has an elliptical cross section. Second hole 89 has a diameter that is slightly larger than the thickest portion of the elliptical cross section. This allows second end 93 to rotate inside second hole 89. However, opening 91 is configured to be slightly larger than the thinnest portion of the second end 93. This allows second end 93 to be moved through opening 91 only when the thinnest portion of the elliptical cross section is lined up appropriately with the opening 91. Once inside second hole 89, second end 93 is rotated so that the thinnest portion of second end 93 is no longer aligned with opening 91, thus preventing pin 83 from moving back through opening 91.

Figure 8:
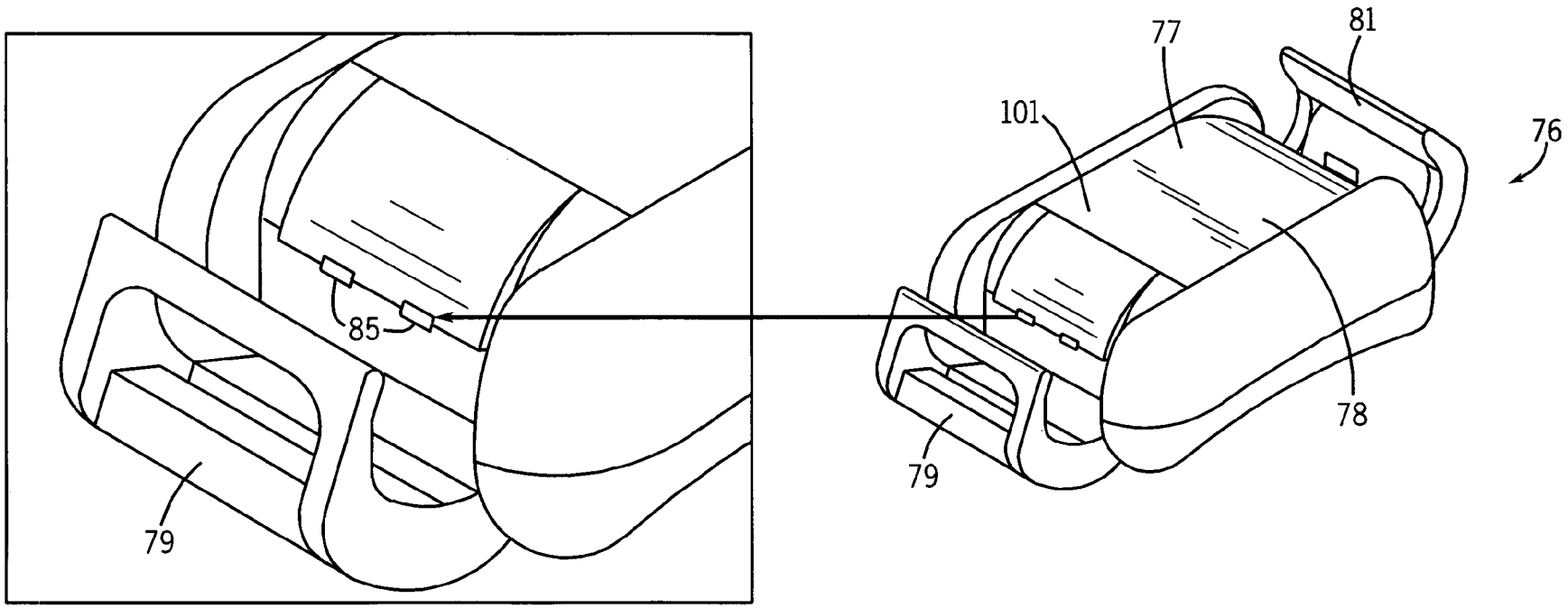

Referring to FIGS. 7 and 8, band 75 is shown cooperatively positioned relative to first connector 79 immediately before moving the first connector 79 to a closed position. When first connector 79 is in the closed position, band 75 is pressed against contacts 85 (FIG. 8) with enough force to allow contacts 85 to pierce the outer surface of band 75 and electrically engage an inner conducting portion of band 75.

In one embodiment, a button 78 activates the mother tag 76. A plurality of visual indicators (referred to hereinafter as light emitting diodes (LEDs)) 80 indicate mother-child information. As shown in FIG. 4, surface 101 may be transparent and LEDs 80 may be positioned underneath surface 101. In the embodiment shown in FIG. 9, the LEDs may be positioned on surface 103 of mother tag 76.

Figure 10:
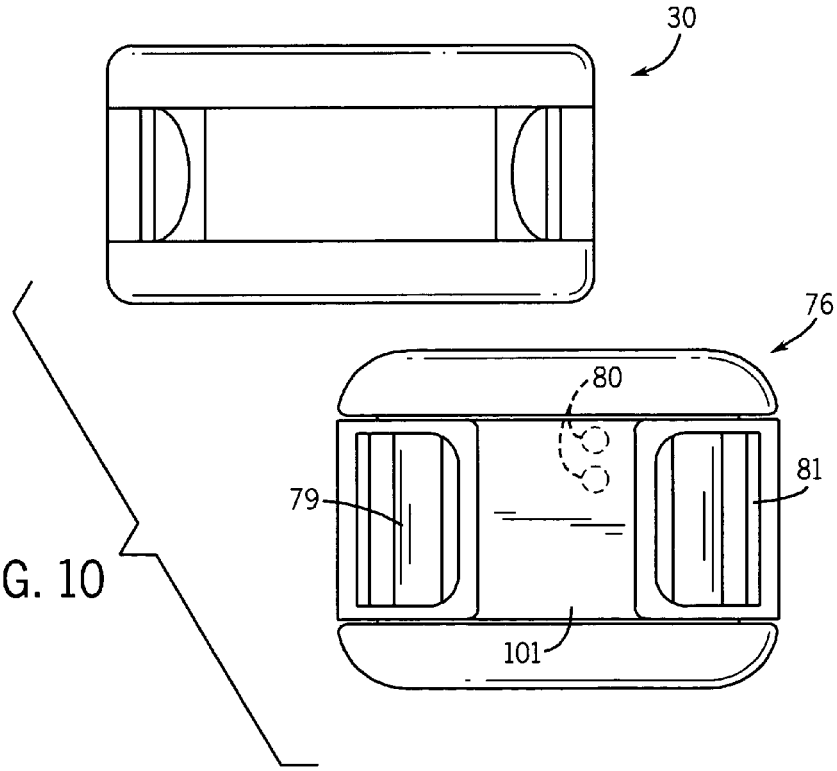
FIG. 10 is a pictorial view of a child tag and a mother tag interacting.

Mother tag 76 may be associated with one or more infant tags 30 in a number of ways. For example, in one embodiment, mother tag 76 may be configured to be linked to a corresponding infant tag 30 during a preset amount of time after band 75 has been coupled to transmitter 77. Once band 75 has been coupled to transmitter 77, infant tag 30 is linked by placing mother tag 76 near (e.g., 10-12 inches or so) infant tag 30 as shown in FIG. 10. In one embodiment, the user has about two minutes from the time band 75 is coupled to transmitter 77 to successfully link mother tag 76 and infant tag 30. In other embodiments, any suitable time may be used (e.g., one minute, three minutes, five minutes, etc.)

In one embodiment, a visual indicator and/or audio indicator may be used to signal that the linking process was or was not successful. For example, one of LEDs 80 may be used to show that mother tag 76 has successfully linked with infant tag 30 by lighting up (e.g., green LED lights up). Also, an audio indication may be used to indicate the linking process was successful (e.g., one beep). A red LED 80 combined with three beeps may be used to show that the mother tag 76 has not successfully linked to infant tag 30 (e.g., displaying a red LED). Any suitable combination of visual and audio indicators may be used to show whether the mother tag 76 is linked with the infant tag 30.

In another embodiment, mother tag 76 may be linked to infant tag 30 without band 75 being coupled to mother tag 76. This may be useful in situations where the mother and child need to be linked but they cannot be brought into close proximity to one another. In yet another embodiment, mother tag 76 may be linked to infant tag 30 even though band 75 is coupled to mother tag 76 and the preset time period has expired. The mother tag 76 may also be programmable to match multiple infants, such as would be needed for twins or triplets.

Figure 11:
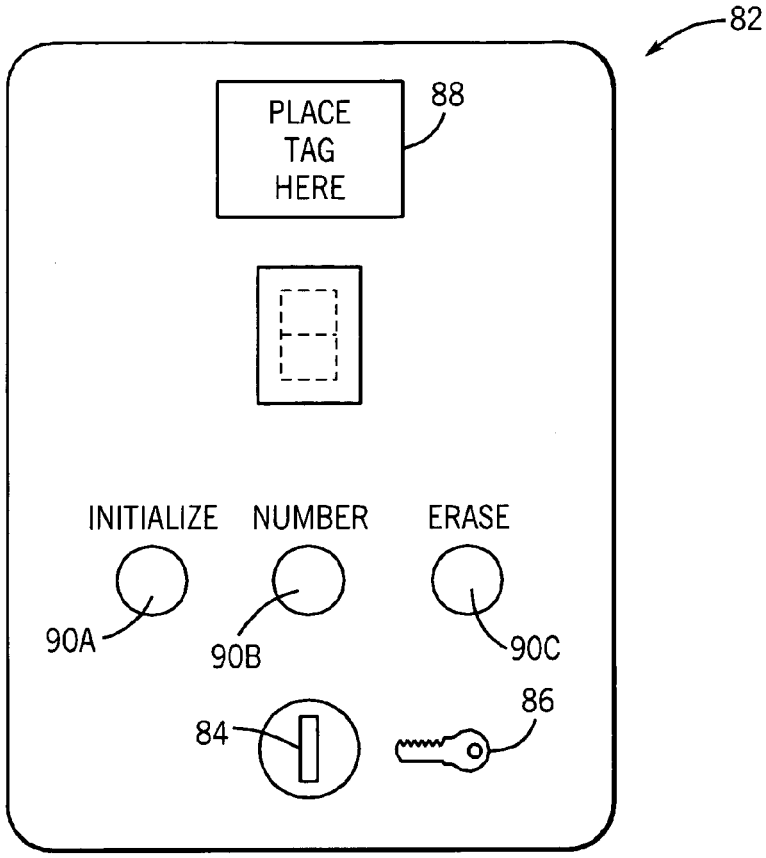
FIG. 11 is an overhead view of an activation/deactivation unit for the present invention.
Figure 12:
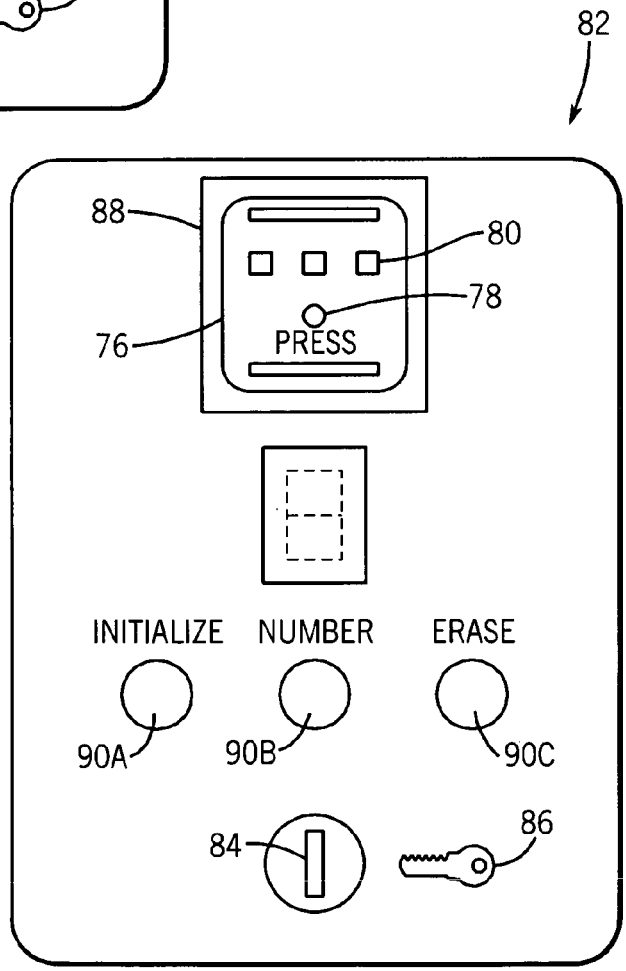
FIG. 12 is an overhead view of the mother tag in FIG. 4 interacting with an initialization/erasure unit as shown in FIG. 6.

FIG. 11 shows an overhead view of an initialization/erasure box 82 in accordance with an exemplary embodiment. A key switch 84 activated by a key 86 secures the box 82 from unauthorized use or tampering. The box 82 is desirably configured to operate only when the key switch 84 is in an unlocked position. The box has a placement space 88 for the mother's tag 76, and a plurality of buttons 90A, 90B, and 90C, used for initializing, setting the number of infants, and erasing a patient's information, respectively. Box 82 is used to initialize a monitoring process, or erase a monitoring process.

In use, the mother's tag 76 is initialized, as illustrated in FIG. 7. Key 86 is placed in key switch 84 and turned to the "on" position. The mother's tag is then placed on the placement space 88. The number of infants is then selected by use of the button 90B. Once the number of infants is selected, the initialization button 90A is pressed, followed by pressing the activation button 78 on the mother's tag 76. The LED 80 on the mother's tag 76 will then signal that the mother's tag 76 is initialized. The box 82 may be located in the remote station 26, and box 82 is connected into the overall system.

Once mother tag 76 and infant tag 30 are linked together, they may then be used to indicate whether a mother matches an infant. This also may be done in a number of ways. Referring to the embodiment of mother tag 76 in FIG. 9, mother tag 76 and infant tag 30 may be used to match a mother and an infant by bringing mother tag 76 and infant tag 30 close to each other. Once mother tag 76 and infant tag 30 are brought close together, one of LEDs 80 lights up indicating that mother tag 76 and infant tag 30 are in close enough proximity to determine if there is a match. The user may then press button 78 to perform a check to see if the mother and infant match. The LEDs 80 show whether the mother and child match are mismatched. Preferably a green light indicates a match and a red light to indicates a mismatch.

In an alternative embodiment, when infant tag 30 is brought near mother tag 76, an indication of a match or mismatch is performed automatically. For example, when a mother tag 76 is brought near (e.g., three feet, two feet, one foot, half a foot, etc.) an unlinked infant's tag 30 the LEDs 80 of the mother tag 76 indicate whether it is linked to the infant tag 30. If infant tag 30 has already been linked to another mother, a warning light may indicate that there is a mismatch.

The same box 82 may be used for erasure of an individual's data. Key 86 is placed in key switch 84 and turned to the "on" position. The mother tag 76 is then placed on the placement space 88. The erasure button 90C is pressed, followed by pressing activation button 78 on the mother's tag 76. LED 80 on the mother tag 76 then signals that the mother's tag 76 has been erased. In another embodiment, mother tag 76 may be erased without the assistance of another unit. For example, mother tag 76 may be erased simply by pressing button 78 multiple times in a certain time frame (e.g., fifteen times in six seconds for example).

In one embodiment, the mother-child match information is recorded in a central computer (not shown). Thus, the central computer logs each time mother tag 76 and infant tag 30 register a match and/or a mismatch. This information may be used to generate a report of the match information. An exemplary report is shown in Table 1. Other report formats may also be employed.

TABLE 1

Mother - Child Activity

| Infant | Transmitter | Mother | Tag | Room | Activity | Time |
|---|---|---|---|---|---|---|
| Smith, James | 10 | Smith, Anita | 24 | 547 | Linked | May 14, 2002 01:08:26 |
| Smith, James | 10 | Smith, Anita | 24 | 547 | Matched | May 14, 2002 06:34:19 |
| Smith, James | 10 | Smith, Anita | 24 | 547 | Matched | May 14, 2002 15:49:11 |
| | | | 24 | 547 | Erased | May 14, 2002 09:17:01 |

Figure 13:
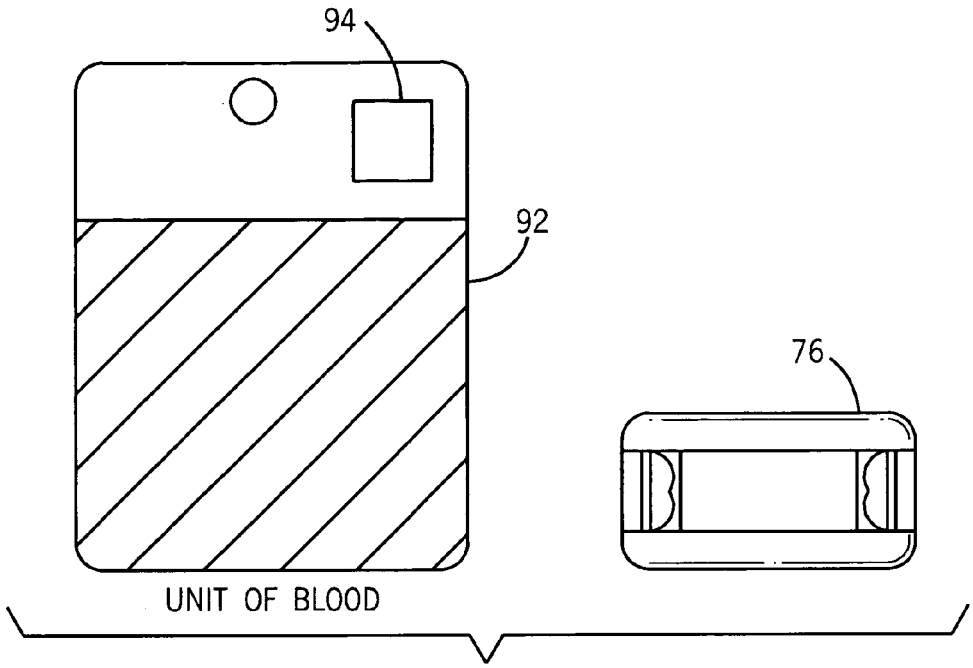
FIG. 13 is a pictorial view of a patient's tag interacting with a blood system.

In addition to monitoring an infant's whereabouts and proper identification between a child and a mother, the system can be adapted for storing a patient's information. For instance, personal information, such as blood type, could be stored in either the mother's tag 76 or the infant tag 30, or both. As shown in FIG. 13, the mother's tag 76 is brought near a unit of blood 92. The blood unit storage container 92 is embedded with a registering device 94, such as a microchip or a barcode, that corresponds to the blood type of the unit 92. When the mother's tag is brought near the unit of blood 92, the LED 80 on the mother's tag 76 indicates whether the mother's blood type and the unit of blood 92 are compatible, thereby reducing potential problems in a hospital setting. Likewise, the infant tag 30 could be brought near the unit of blood 92 to show compatibility.

Figure 14:
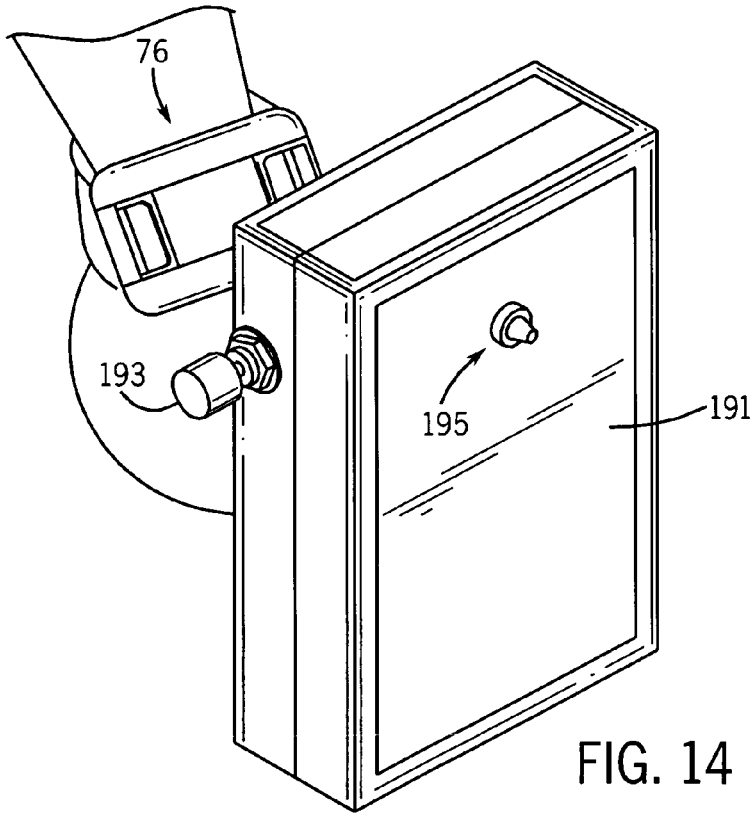
FIG. 14 is a pictorial view of a mother tag interacting with a test unit.

Referring to FIG. 14, a test unit 191 may be used to check the status of mother tag 76. In one embodiment, mother tag 76 is placed directly on test unit 191. Button 193 is pressed and held down. If the mother tag 76 is working properly, the indicator light 195 flashes and/or a tone is sounded. If the indicator light 195 does not flash then mother tag 76 has failed the test.

Figure 15:
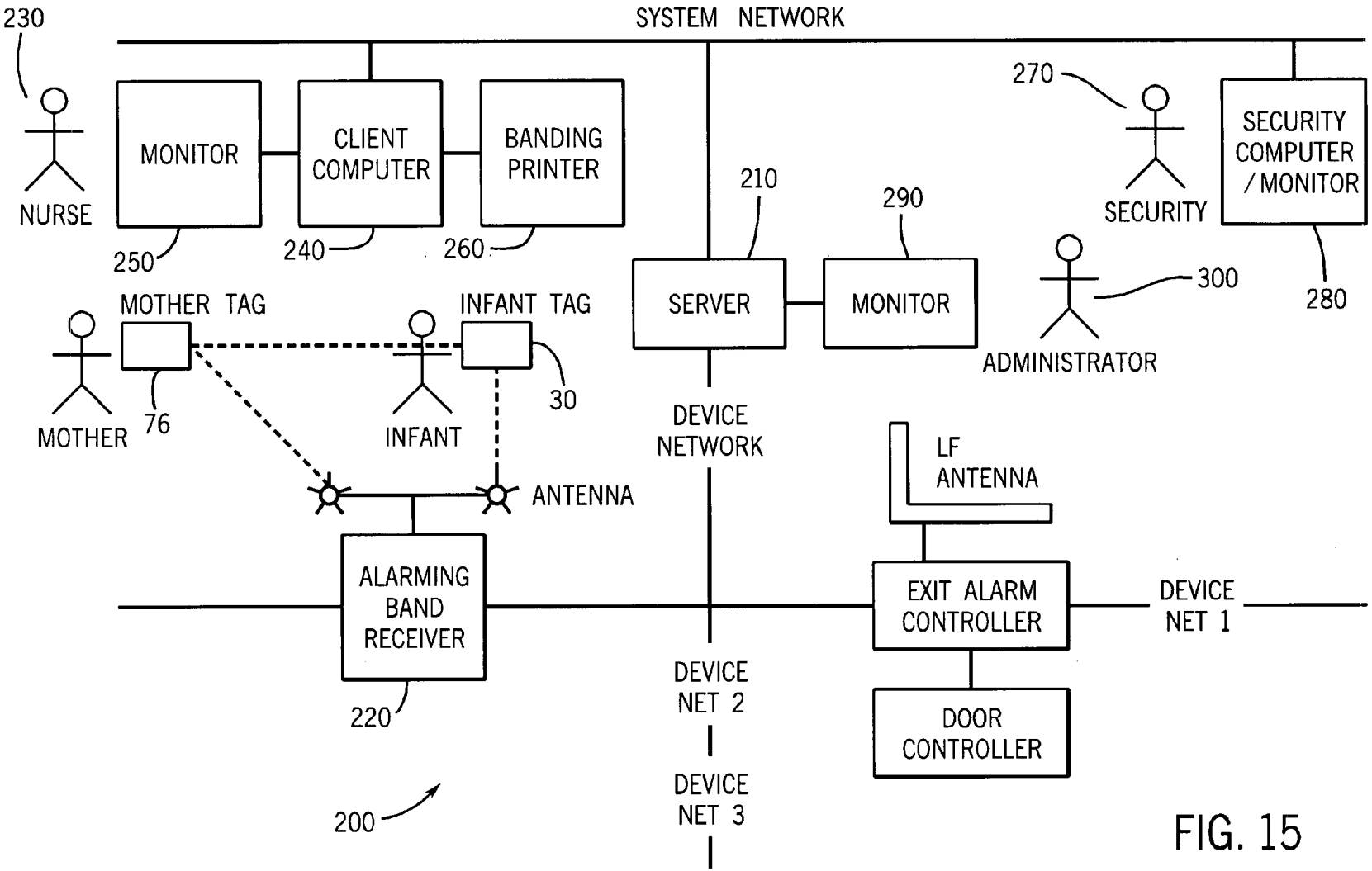
FIG. 15 is a diagram of a security system according to one embodiment.

The mother-baby matching system 200 discussed and depicted in FIG. 15 is comprised of two primary components according to an exemplary embodiment, the mother tag 76 and infant tag 30. The mother tag 76 may be designed to store single, double, or triple infant transmitter(s) numerical ID(s) and be worn by the mother during her stay at the hospital. When placed near an infant tag 30 the mother tag 76 receives the ID beacon (LF) from infant tag 30 and determines if the tag matches an ID stored in memory. Colored LEDs and a piezoelectric buzzer may be used to indicate whether a successful or unsuccessful match has taken place. Multiple births require the use of twin and triplet mother tags 76 that allow matching to more than one infant. After mother tag 76 is banded (activated), it must be linked to at least one infant tag 30 by reading the ID beacon sent from the infant tag 30. The initial read may serve as the linking process. Infant tag's 30 ID(s) may be stored in EEPROM, or other memory, on the mother tag 76 so that they can be used to check for a match during subsequent activations.

A server computer 210 may be used to keep a record of all match events and mother-infant pairs, and display any mother-baby match alarms or warning events. To achieve this functionality, mother tag 76 is equipped with a transmitter circuit that sends data for each cut-band, link, match, mismatch and erase events. The alarming band receivers 220 will receive this data and then pass it on to server 210 on the device network which in an exemplary embodiment may be an RS-485 network using a CA9450 Protocol. Also, according to an exemplary embodiment, 30 minutes after the tag has been removed from a user, the tag erases itself and returns to a hibernated state (deep sleep) to allow reuse.

Figure 9:
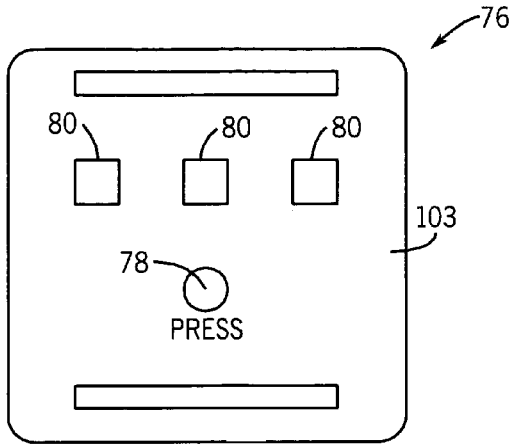

Referring to FIG. 9, nurse 230 may be the infant and mother's primary care giver. Nurse 230 may have system administrative feature control, but is normally limited to functions required for patient care, e.g. admit, discharge, transfer, transport, and adjust. Nurse 230 may have a system 240 with display devices 250 to monitor and administer infant security within a labor and delivery unit, to prevent abduction of infants. Nurse 230 may utilize the mother/infant tag system to link infants to mothers such that all subsequent mother infant encounters will indicate that the infant belongs to the mother.

The tag system may provide both an audio and visual alarm when a band is removed from an infant, according to an exemplary embodiment. The tag system may also provide both an audio and visual alarm when a band is removed from a mother. Further, the tag system may provide an audio and visual alarm when an infant is present at an exit door and the door is opened. Further still, the tag system may provide an audio and visual alarm when a mother tag has been reused without proper discharge from the system.

When the infant tag 30 or mother tag 76 battery is low, an alarm and/or other notification may be provided to nurse 230 for servicing. Alarms may be cleared by nurse 230 via functions on the tags or through client system 240. Monitor 250 may be used to view detailed alarm event properties—alarm types, mother and infant admit records, etc. Monitor 250 may be located at a desk, at the nurse's central station, or mounted to a hallway wall. The display device may be configured with security features (such as but not limited to password protected logins) to disallow unattended use of the system.

According to an exemplary embodiment, nurse 230 may be able to auto enroll an infant to the system by activating infant tag 30. In another exemplary embodiment, nurse 230 may be able to auto enroll an infant to the system by activating mother tag 76. Further, nurse 230 may be able to pre-admit an infant to the system and/or a mother to the system. Nurse 230 may also be able to pre-populate the relevant infant fields from the mother pre-admit information.

According to another exemplary embodiment, nurse 230 may be able to pre-admit one or more infants per mother or two infants per mother. Nurse 230 may be able to link auto-enrolled tags with pre-admit mother/infant data. Using a banding printer 260, nurse 230 may be able to receive printed transmitter bands upon pre-admit to the system. The printed band may contain all the information to replace the traditional mother/infant wristband. Nurse 230 may be able to print transmitter bands for auto enrolled mother, father and infant(s).

According to an exemplary embodiment, nurse 230 may be able to link mother tag 76 to infant tag 30 up to 2 hours after activation of mother tag 76. Nurse 230 may be able to identify that a match between an infant that belongs to a mother through visual and audio indications on the mother tag when the infant tag is brought within proximity of the mother tag. Preferably, the indication should take less than 2 seconds once the mother and infant tag are within range of each other. Nurse 230 may be able to visually identify a match between an infant and a father by using identifications found on the father and infant bands. Nurse 230 may be able to link multiple infants to a single mother either through pre-admitting or through auto enrollment.

In an exemplary embodiment, nurse 230 may request the system to generate a priority 3 alarm/warning message to remind him/her to check for mother tag 76 slippage, 4 hours after activation (the slippage check time may be Administrator configurable). Nurse 230 may be able to pause individual infant tag 30 band alarms for a variable amount of time to allow band changes and cleaning. Nurse 230 may be able to pause infant tag triggered exit alarms for the temporary transport of the infant to other uncontrolled units of the hospital, for example, radiology. Infant tag 30 exit alarms may automatically re-enable the exit alarm functionality when the infant tag 30 is detected on the hospital unit.

In an exemplary embodiment, the tag system may be configured so that a match event occurs within 5 minutes of discharge (time may be configurable by an administrator, for example). Nurse 230 may receive a reminder message from the system during the discharge function, that a match must be performed before the discharge can be completed (cut-band). A confirmation to nurse 230 is provided by an alarm/warning message (priority 3) from the system when an admit or discharge function has completed (may be Administrator configurable). The tag system may provide a discharge record printout after mother/infant are selected. The tag system provides a method to generate reports based on mother-baby match event data. These reports may be available from monitor 250, monitor 290, other monitors, printers, or other output devices.

According to an exemplary embodiment, mother tag 76 may be activated by banding it to the mother. A time delay of 1 minute (alternatively, other time delays may be used) may be applied after initially attaching the band, to adjust the band for fit (detach and reattach) without mother tag cut-band alarms. Similarly, infant tag 30 may be activated by banding the infant. Infant tag 30 may automatically enroll when banded to the infant if not pre-admitted. A time delay of 1 minute (alternatively, other time delays may be used) may be applied after initially attaching the band, to adjust the band for fit (detach and reattach) without infant tag cut-band alarms.

In an exemplary embodiment, mother tag 76 begins the linking process automatically after banding. The mother tag 76 may automatically link the first found infant for 2 hours (alternatively, other time delays may be used) after activation (banding). The tags may automatically link when the nurse brings the tags within 6 inches of each other. In an exemplary embodiment, the mother tag 76 may flash the green LED and beep to indicate a link has been made. An indication may be received from mother tag 76 (LEDs/sound) when its looking to accept additional infant links (twin or triplet mother tag only). Mother tag 76 may be configured to flash the red LED and beep when linking cannot occur. In an exemplary embodiment, mother tag 76 may indicate low battery and will not link to infant tag 30. The tag system may be configured to create an alarm/warning message (priority 2) when mother and infant linking did not occur within 2 hours (tag will no longer link without re-banding). The link event may be recorded for report generation.

During the matching process, an automatic match response may be provided within 2 seconds after the tags are within sense range. A match response may be provided within 2 second after pressing the Match/Link button when tags are within sense range. Alternatively, other response times not limited to 2 seconds may be used. Successful matching may be indicated with a confirmation LED and audio beep pattern when button initiated. Successful matching may be indicated with a confirmation LED pattern when automatically initiated. In an exemplary embodiment, unsuccessful matching (mismatch) may be indicated with an error LED and audio pattern. Also, mother tag 76 may be configured to remain silent and the LED to pulse (fade in and out) to indicate matching if kept within a 6 inch, or other transmitter power determined, sensing zone.

In an exemplary embodiment, security user 270 may be able to interface with a security computer or monitor 280 that is coupled to the system network. The security user interfaces with a display device that may be located at any of a variety of location within a hospital environment or outside thereof. The security user's interface may be/located at a desk, a security station, or virtually anywhere an interfacing device may be located. The security computer may be configured to display priority 1 system alarms, or other alarms, in a timely manner. Various pieces of information may be displayed to the security user 270 including but not limited to the location of the alarm event, the name of the mother and/or the infant, the type of alarm, etc.

Server 210 which is coupled to the system network may be coupled to a monitor 290 for interfacing with an administrator 300. Server 210 may be a PC based Windows 2000 workstation or other type of computer system server. Access may be provided to server 210 to administrator 300 through a password protected or otherwise security protected system.

Client computer 240 may be configured to provide reports relating to mother tag and infant tag patients. The reports may include but are not limited to infant's name, events, event times, mother's name, infant room, mother's room, infant tag, mother tag, groups, etc. The client computer 240 may be configured to provide a mother census report which may contain the mother's name, mother's room, time of admission, nurse, number of infants, mother tag, match status, group, etc. Further still, a discharge record may be automatically printed from client computer 240 upon discharge or upon initiating the discharge procedure.

In an exemplary embodiment, mother tag 76 may be a waterproof tag which allows for bathing and showering and in which the associated electronics are protected from any water infiltration. Mother tag 76 desirably has integrated slots for banding material attachment. The banding material attachment may include a watch or timekeeping device attached or attachable thereto. Mother tag 76 may be configured for accepting an adhesive label with applicable logos, product identification, and windows for LEDs. In an exemplary embodiment, mother tag 76 may include a non-volatile memory which stores matching infant transmitters IDs. In another exemplary embodiment, mother tag 76 includes at least two LEDs for user interface, which may be a red LED and a green LED. Mother tag 76 may have a low frequency (66 and 262 kHz) receive circuit with 6-12 inch read range from the infant transmitter. The mother tag 76 further has an ultra high frequency (UHF 318 MHz) transmitter circuit.

In an exemplary embodiment, the alarm banding material is configured not to contain latex. The material may contain three layers, Propad-Lite, Flectron Copper Ripstop Fabric, and polyethylene film. The banding material may be in the range of approximately 0.560 inches wide and 0.015 inches thick. Alternatively, any other materials may be used including latex materials and further including any of a variety of sizes of banding material. In a particular exemplary embodiment, the banding material may have a top surface that is capable of accepting thermal printing which displays in printed form the mother/infant name, patient account number, bar code, doctor, date/time admitted, and room number.

In an exemplary embodiment, a polling service polls each device on the device network and then receives responses according to a CA9450 protocol design. However, any of a variety of other types of protocol designs may equally be applied. Mother tag messages may be separated from the reply packet. The mother tag messages are passed on to the status service in a distributed component object model (DCOM) packet. No new services are required from a polling service to support the mother/baby match system. Match/mismatch messages may be transferred to the status service using a transfer tag PKT (tag, status, RSSI, dev) message.

In an exemplary embodiment, mother tag 76 and/or infant tag 30 include a "check-in" feature so that mother tag 76 and/or infant tag 30 check-in or establish contact (e.g., transmit a signal to the system, etc.) with the system at least once during a regular interval. In one embodiment, tags 76, 30 may be configured to check-in at least once during every ten second interval. If a tag 76, 30 fails to check in during this interval, a notification is provided to initiate further follow-up. Alternatively, when a tag 76, 30 fails to check in the secured area 20 may be locked down.

In an exemplary embodiment, a status service is used to receive data from devices, post events to client computers, record historical information, handle event timing, and issue commands to devices. The status service may be run on server 210. The status service has the function of determining when the standard tag message contains mother information and then acts accordingly. The mother tag message includes an M flag to identify itself apart from the normal infant tags 30. The messages are logged to the database history and match tables. The status service may also be responsible for timing infant match/discharge events and making sure that infant IDs are not linked to more than one mother tag. Warning events (yellow, medium priority) may be posted to the client computers in those cases. Mismatch events may generate a yellow or medium priority alarm event that may be posted to the client computers. The status for the infant for which the mismatch event has occurred may be updated in both the database and in the status service memory database tables.

If an infant transmitter is not already auto-enrolled or admitted, a link event from a mother tag may cause the infant transmitter to be auto-enrolled. The status service sends a notification to the clients of the auto-enroll event, enters the information into the database, and updates the database. If an infant transmitter is already auto-enrolled or admitted when the link event occurs, the infant record is updated, and the mother linked flag is set.

The database stores each link, match, and erase event from the mother tag in the history table. The infant table includes fields for the mother name, room, nurse, and memos.

The status service may also be configured to log active transmitters (both mother and infant) that are currently unassigned until the mother or infant has been admitted and the transmitter is associated with the mother or infant. Also, the status service may create an audit trial of all users that accessed the system. In addition, the status service may be used provide reports that include information such as: a list of all banded mothers and/or infants, a log of all activities for a particular mother and/or infant, a log of when band adjustments were made, a transport history of a mother and/or infant, current status of all mothers and/or infants (e.g., in transport, discharged, band being adjusted, etc.), as well as a list of all tags that have a low battery.

While the detailed drawings, specific examples and particular formulations given describe preferred and exemplary embodiments, they serve the purpose of illustration only. The inventions disclosed are not limited to the specific forms shown. For example, the methods may be performed in any of a variety of sequence of steps. The hardware and software configurations shown and described may differ depending on the chosen performance characteristics and physical characteristics of the computing devices. For example, the type of computing device, communications bus, or processor used may differ. The systems and methods depicted and described are not limited to the precise details and conditions disclosed. Furthermore, other substitutions, modifications, changes, and omissions may be made in the design, operating conditions, and arrangement of the exemplary embodiments without departing from the scope of the invention as expressed in the appended claims.

What is claimed is:

1. A mother and infant matching and security system comprising:

a first tag unit adapted to be secured to an infant, the first tag unit being operable to transmit a first radio signal having a low frequency and a second radio signal having a very high frequency; and a second tag unit adapted to be secured to a mother of the infant, the second tag unit communicating with the first tag unit via a radio communication link according to a communications protocol;

wherein a match of the first tag unit and second tag unit is identified by both an audio indicator and a visual indicator on at least one of the first tag unit and the second tag unit.

2. The mother and infant matching and security system of claim 1, wherein the radio communication link is established over the low frequency.

3. The mother and infant matching and security system of claim 2, wherein the low frequency is in the range of 50 to 300 kHz.

4. The mother and infant matching and security system of claim 1, wherein the match is identified automatically.

5. The mother and infant matching and security system of claim 4, wherein the automated match identification is provided within 2 seconds after the first and second tag units are within sense range.

6. The mother and infant matching and security system of claim 1, wherein the match is identified upon manual initiation.

7. The mother and infant matching and security system of claim 6, wherein the match identification is provided within 2 seconds after the manual initiation.

8. The mother and infant matching and security system of claim 1, wherein the visual indication includes a light indication.

9. The mother and infant matching and security system of claim 1, wherein the audio indication includes an audio beep.

10. The mother and infant matching and security system of claim 1, wherein the visual indication may remain active after the audio indication ends and the first and second tag units are kept within a sense range.

11. The mother and infant matching and security system of claim 1, wherein an automatic matching sequence may be initiated if the first and second tag units have been out of a sense range for more than a predetermined amount of time and then brought back into the sense range.

12. The mother and infant matching and security system of claim 1, further comprising:

a plurality of receivers located within an enclosed area or room, said receivers capable of receiving signals from said first and said second tag unit, said receivers monitoring the presence of the infant.

13. The mother and infant matching and security system of claim 1, wherein an initial linking process is performed automatically when the first and second tags are first brought into a sense range.

14. The mother and infant matching and security system of claim 1, wherein the second tag allows for more than one first tag unit to be matched with the second tag unit.

15. The mother and infant matching and security system of claim 1, wherein the second tag unit is erased and deactivated after a predetermined time period after being removed from the mother.

16. The mother and infant matching and security system of claim 1, further comprising:

a computer processing system, said computer processing system giving a report on the mother and infant system.

17. The mother and infant matching and security system of claim 1, wherein the audio indicator is provided on the second tag unit.

18. A method of identifying two matching persons or objects, the method comprising:

securing a first tag unit to a first person or object, the first tag unit being operable to transmit a first radio signal having a low frequency and a second radio signal having a very high frequency;

securing a second tag unit to a second person or object, the second tag unit having a radio communication link with the first tag unit;

communicating using a predefined communications protocol from the first tag unit to the second tag unit via a radio communications link; and identifying a match of the first tag unit and the second tag unit by both an audio indicator and a visual indicator on at least one of the first tag unit and the second tag unit.

19. The method of claim 18, further comprising:

bringing the first tag unit within a sense range of the second tag unit.

20. The method of claim 18, wherein the first object or person is a unit of blood.

21. The method of claim 18, wherein the first object or person is an infant.

22. The method of claim 21, wherein the second object or person is the mother of the infant.

23. The method of claim 18, further comprising:

deactivating the audio indicator after a predetermined time and maintaining the visual indicator until the first and second tag are removed from a sense range.

24. The method of claim 18, wherein the audio indicator is provided on the second tag unit, wherein the second tag unit is associated with a mother of an infant attached to the first tag unit.

25. A tagging and identification system comprising:

a first communications network;

a server coupled to the first communications network;

a tag unit receiver coupled to the first communications network;

a first tag unit adapted to be secured to an infant, the first tag unit being operable to transmit a first radio signal having a low frequency and a second radio signal having a very high frequency;

a second tag unit adapted to be secured to a mother of the infant, the second tag unit having a radio communication link with the first tag unit; and a communications protocol used by the first tag unit to communicate via the radio communications link with the second tag unit, wherein a match of the first tag unit and second tag unit is identified by both an audio indicator and a visual indicator on at least one of the first tag unit and the second tag unit.

26. The tagging and identification system of claim 25, wherein the radio communication link is established over the low frequency.

27. The tagging and identification system of claim 25, wherein the low frequency is in the range of 50 to 300 kHz.

28. The tagging and identification system of claim 25, wherein the match is identified automatically.

29. The tagging and identification system of claim 28, wherein the automated match identification is provided within 2 seconds after the first and second tag units are within sense range.

30. The tagging and identification system of claim 25, wherein the match is identified upon manual initiation.

31. The tagging and identification system of claim 30, wherein the match identification is provided within 2 seconds after the manual initiation.

32. The tagging and identification system of claim 25, wherein the visual indication includes a light indication.

33. The tagging and identification system of claim 25, wherein the audio indication includes an audio beep.

34. The tagging and identification system of claim 25, wherein the visual indication may remain active after the audio indication ends and the first and second tag units are kept within a sense range.

35. The tagging and identification system of claim 25, wherein an automatic matching sequence may be initiated if the first and second tag units have been out of a sense range for more than a predetermined amount of time and then brought back into the sense range.

36. The tagging and identification system of claim 25, further comprising:

a plurality of receivers located within an enclosed area or room, said receivers capable of receiving signals from said first and said second tag unit, said receivers monitoring the presence of the infant.

37. The tagging and identification system of claim 25, further comprising:

a report generation system, capable of providing reports related to the first tag unit and the second tag unit.

38. The tagging and identification system of claim 25, wherein an initial linking process is performed automatically when the first and second tags are first brought into a sense range.

39. The tagging and identification system of claim 25, wherein the second tag allows for more than one first tag unit to be matched with the second tag unit.

40. The tagging and identification system of claim 25, wherein the second tag unit is erased and deactivated after a predetermined time period after being removed from the mother.

41. The tagging and identification system of claim 25, further comprising:

a computer processing system, said computer processing system giving a report on the mother and infant system.

42. The tagging and identification system of claim 25, wherein the audio indicator is provided on the second tag unit.

* * * * *